US010760163B2

(12) United States Patent
Yoo et al.

(10) Patent No.: US 10,760,163 B2
(45) Date of Patent: Sep. 1, 2020

(54) SURFACE TREATMENT METHOD OF ALUMINUM FOR BONDING DIFFERENT MATERIALS

(71) Applicants: Hyundai Motor Company, Seoul (KR); Kia Motors Corporation, Seoul (KR)

(72) Inventors: Chang-Yeol Yoo, Gyeonggi-Do (KR); Byung-Seok Kong, Gyeonggi-Do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/156,699

(22) Filed: Oct. 10, 2018

(65) Prior Publication Data

US 2019/0127857 A1 May 2, 2019

(30) Foreign Application Priority Data

Oct. 27, 2017 (KR) ..... 10-2017-0141227

(51) Int. Cl.

| | |
|---|---|
| ***C23F 1/20*** | (2006.01) |
| ***C23G 1/22*** | (2006.01) |
| ***B05D 3/00*** | (2006.01) |
| ***B05D 1/24*** | (2006.01) |
| ***C23G 1/00*** | (2006.01) |
| ***C23C 22/83*** | (2006.01) |
| ***B05D 3/10*** | (2006.01) |
| ***C23G 1/12*** | (2006.01) |
| ***C25F 1/04*** | (2006.01) |
| ***C23C 22/68*** | (2006.01) |

(52) U.S. Cl.

CPC ..... *C23F 1/20* (2013.01); *B05D 1/24* (2013.01); *B05D 3/002* (2013.01); *B05D 3/102* (2013.01); *C23C 22/68* (2013.01); *C23C 22/83* (2013.01); *C23G 1/00* (2013.01); *C23G 1/125* (2013.01); *C23G 1/22* (2013.01); *C25F 1/04* (2013.01); *B05D 2202/25* (2013.01); *B05D 2350/30* (2013.01); *B05D 2350/63* (2013.01)

(58) Field of Classification Search

None

See application file for complete search history.

(56) References Cited

U.S. PATENT DOCUMENTS 3,416,223 A * 12/1968 Walz ..... H01L 35/34 136/201
4,956,619 A * 9/1990 Hornbeck ..... G02B 26/0841 348/771
5,876,614 A * 3/1999 Zhou ..... H01L 21/0276 216/101

(Continued)

FOREIGN PATENT DOCUMENTS

JP 56-102575 8/1981
JP 62042434 A * 2/1987 ..... H01L 21/30655

(Continued)

*Primary Examiner* — Allan W. Olsen

(74) *Attorney, Agent, or Firm* — Mintz Levin Cohn Ferris Glovsky and Popeo, P.C.; Peter F. Corless

(57) ABSTRACT

Disclosed is a method of fabricating an aluminum alloy member for bonding different materials. The method may include etching the aluminum alloy member with one or more etching solutions, and forming one or more undercuts on a surface of the aluminum alloy member.

15 Claims, 7 Drawing Sheets

(56) References Cited

U.S. PATENT DOCUMENTS

| | | | | |
|---|---|---|---|---|
| 6,156,662 | A * | 12/2000 | Ohori | G02F 1/1362 438/694 |
| 6,468,439 | B1 * | 10/2002 | Whitehurst | C23F 1/02 216/100 |
| 6,799,869 | B1 * | 10/2004 | Beadle | F21V 7/22 362/267 |
| 9,653,309 | B2 * | 5/2017 | Dynes | H01L 21/302 |
| 10,273,590 | B2 * | 4/2019 | Yoo | C08K 3/22 |
| 2006/0022199 | A1 * | 2/2006 | Ishiga | G02F 1/133555 257/59 |
| 2008/0094775 | A1 * | 4/2008 | Sneh | H01G 4/10 361/275.3 |
| 2011/0008644 | A1 * | 1/2011 | Naritomi | B29C 45/14311 428/612 |
| 2012/0040132 | A1 * | 2/2012 | Eto | B32B 15/016 428/131 |
| 2012/0135222 | A1 * | 5/2012 | Chang | C23C 14/021 428/306.6 |
| 2014/0030632 | A1 * | 1/2014 | Larsen | H01M 8/021 429/507 |
| 2014/0041196 | A1 * | 2/2014 | Bae | B21C 37/00 29/458 |
| 2017/0256416 | A1 * | 9/2017 | Fischer | C23C 16/0245 |
| 2018/0247832 | A1 * | 8/2018 | Fischer | H01L 21/225 |

FOREIGN PATENT DOCUMENTS

| | | | |
|---|---|---|---|
| JP | 04096327 | A * | 3/1992 |
| KR | 10-1389989 | B1 | 5/2014 |

* cited by examiner

SURFACE PHOTO BY PLASMA COATING

SURFACE PHOTO BY IMMERSION COATING

| Division | No etching | primary etching | primary etching + secondary etching | primary etching + secondary etching + tertiary etching |
|---|---|---|---|---|
| room temperature adhesion (MPa) | 0 | 5 | 10 | 30 |
| Organization photo |  |  |  |  |
| Explanation | No etching | surface etching | Si etching | Penetration etching |

SURFACE TREATMENT METHOD OF ALUMINUM FOR BONDING DIFFERENT MATERIALS

CROSS-REFERENCE TO RELATED APPLICATION

The present application claims priority of Korean Patent Application No. 10-2017-0141227 filed on Oct. 27, 2017, the entire contents of which is incorporated herein for all purposes by this reference.

TECHNICAL FIELD

The present invention relates to a surface treatment method of aluminum for bonding plastic material on aluminum.

BACKGROUND

When plastic material parts are attached to aluminum material member, surface treatment may be performed on aluminum surface.

In the related field, various vehicle parts have been produced by attaching or adhering different materials, such as plastic and metal components, to reduce weight of the vehicle. For example, when the plastic material is attached to the aluminum tube and the like, the coating layer may be formed by the coating material combining the ceramic powder and the nickel binder and the plasma may be used to bond the different materials of the aluminum material and the plastic material to each other.

However, in such a plasma-based method, adhesion may be deteriorated due to softening of aluminum and plastic resin at high temperature. For example, when the surface is treated with an undercut shape, it may be exposed to moisture at a high temperature of 200° C. or greater. As a result, when moisture may penetrate, corrode may occur on the aluminum surface and adhesion may be deteriorated.

The foregoing is intended merely to aid in the understanding of the background of the present invention, and is not intended to mean that the present invention falls within the purview of the related art that is already known to those skilled in the art.

SUMMARY OF THE INVENTION

In preferred aspects, the present invention provides a surface treatment method, or a method of fabricating an aluminum alloy member for bonding different materials to improve adhesion of these materials (e.g., a plastic part on an aluminum alloy part) at high temperatures.

In one aspect, provided is a method of fabricating an aluminum alloy member. The method may include: etching the aluminum alloy member with one or more etching solutions; and forming one or more undercuts on a surface of the aluminum alloy member.

The term "aluminum alloy member" as used herein refers to a metallic member or a metallic article formed with aluminum alloy containing Al as a major component, for example, greater than about 80 wt %, greater than about 85 wt %, greater than about 90 wt %, greater than about 92 wt %, greater than about 93 wt %, greater than about 94 wt %, greater than about 95 wt %, greater than about 96 wt %, greater than about 97 wt %, greater than about 98 wt %, or greater than about 99 wt % based on the total weight of the member.

The term "undercut" or "undercuts" as used herein refers to a structure formed under or beneath a surface or a surface level. Preferred undercuts may suitably form a space by removing a material from the surface level, for example, by etching (e.g., chemical etching or physical etching), scrapping, digging, cutting, or shaving or the like. Exemplary dimensions of an undercut may include may include a depth of at least about 1 μm, at least about 10 μm, or at least about 20 μm, from the planar surface of the aluminum alloy member, more specifically a depth from about 10 μm to 500 μm, from about 10 μm to 200 μm, or from about 20 μm to 100 μm from the planar surface of the aluminum alloy member.

An undercuts suitably may suitably have a width of at least about 10 μm, at least about 100 μm, at least about 500 μm, or at least about 1 mm, more specifically a width from about 10 μm to about 1 mm, from about 10 μm to about 500 μm, or from about 10 μm to about 100 μm. In addition, such undercuts suitably may suitably have a length of at least about 100 μm, at least about 500 μm, at least about 1 mm, or at least about 10 mm, more specifically a width from about 100 μm to about 10 mm, from about 100 μm to about 5 mm, or from about 100 μm to about 1 mm.

The one or more of the etching solutions may be same or different. The one or more of the etching solution may be sequentially applied on the aluminum alloy member. Preferably, the one or more undercuts may be formed by a first etching of immersing the aluminum alloy member in $CrO_3$ aqueous solution; a second etching of immersing the aluminum alloy member in $FeCl_3$ aqueous solution; and a third etching of immersing the aluminum alloy member in an HCl aqueous solution.

The first etching may suitably include immersing the aluminum alloy member in the $CrO_3$ aqueous solution of a temperature of about 20 to 30° C. In addition, the first etching may suitably include immersing the aluminum alloy member in the $CrO_3$ aqueous solution for 3 minutes.

Herein, the $CrO_3$ aqueous solution may suitably have a concentration of $CrO_3$ of about 150 g/l to 200 g/l.

Furthermore, the second etching may suitably include the aluminum alloy member in the $FeCl_3$ aqueous solution of a temperature of about 20 to 30° C. In addition, the second etching may suitably include the aluminum alloy member in the $FeCl_3$ aqueous solution for 0.5 to 1 minutes.

The $FeCl_3$ aqueous solution may suitably have a concentration of $FeCl_3$ of about 50 g/l to 150 g/l.

The third etching may suitably include the aluminum alloy member in the HCl aqueous solution of a temperature of about 20 to 30° C. In addition, the third etching may suitably include the aluminum alloy member in the HCl aqueous solution for about 0.5 to 1 minutes.

The HCl aqueous solution may suitably have a concentration of HCl of about 50 g/l to 150 g/l.

The method may further include coating $TiO_2$ powder on the undercut. The coating the $TiO_2$ powder may suitably include immersing the aluminum alloy member in the $TiO_2$ aqueous solution comprising the $TiO_2$ powder to coating. The $TiO_2$ aqueous solution may have a concentration of the $TiO_2$ powder of about 1 to 100 mg/l, of about 10 to 50 mg/l, of about 20 to 30 mg/l, or particularly about 20 mg/l.

The coating the $TiO_2$ powder may suitably include immersing the aluminum alloy member in the $TiO_2$ aqueous solution at a temperature of about 20 to 30° C. In addition, the coating the $TiO_2$ powder may suitably include immersing the aluminum alloy member in the $TiO_2$ aqueous solution for 0.5-1 minutes.

In another aspect, provided is an aluminum alloy member manufactured by the method as described herein.

Further provided is a vehicle part including the aluminum alloy member as described herein.

In various exemplary embodiments of the present invention, the surface treatment method on the aluminum alloy member for bonding different materials (e.g., plastic material and aluminum material) may include three steps etching to form an undercut shape on the surface, thereby exhibiting excellent bonding performance.

In addition, by using ceramic powder of $TiO_2$ instead of $SiO_2$, the thermal stability may be greater and the excellent bonding performance may be obtained particularly, because $TiO_2$ may not change in the high temperature and moisture environment.

As such, adhesion between the different materials may be substantially improved by treating the aluminum surface through immersion comparing to the conventional method using plasma.

Furthermore, due to the immersion method, the coating layer may be well deposited on the surface-treated undercut shape to contribute to adhesion improvement.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

In order to fully understand the present invention, the operational advantages of the present invention, and the objects attained by the practice of the present invention, reference should be made to the appended drawings illustrating the preferred embodiments of the invention and the description in the accompanying drawings.

In describing a preferred exemplary embodiment of the present invention, known techniques or repetitive descriptions that may unnecessarily obscure the essence of the present invention would either reduce or omit the description thereof.

Figure 1:
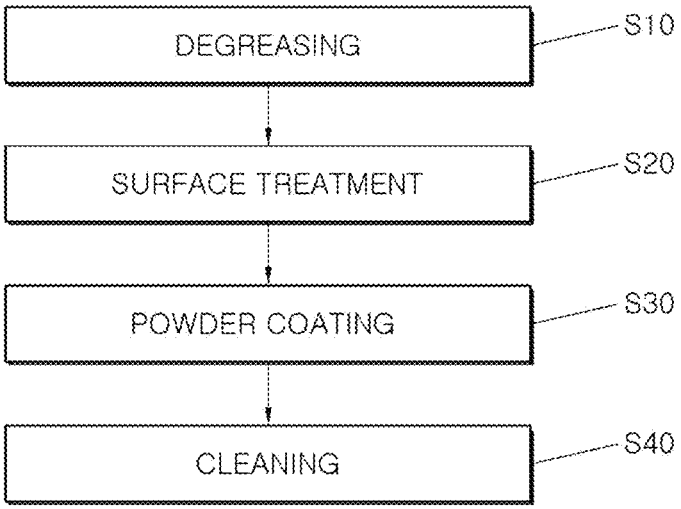
FIG. 1 is a flow chart of an exemplary surface treatment method of fabricating an aluminum alloy member for bonding different materials according an exemplary embodiment of the present invention.

FIG. 1 shows an exemplary flow chart of an exemplary surface treatment method of fabricating an aluminum alloy member for bonding different materials by the present invention.

Figure 2:
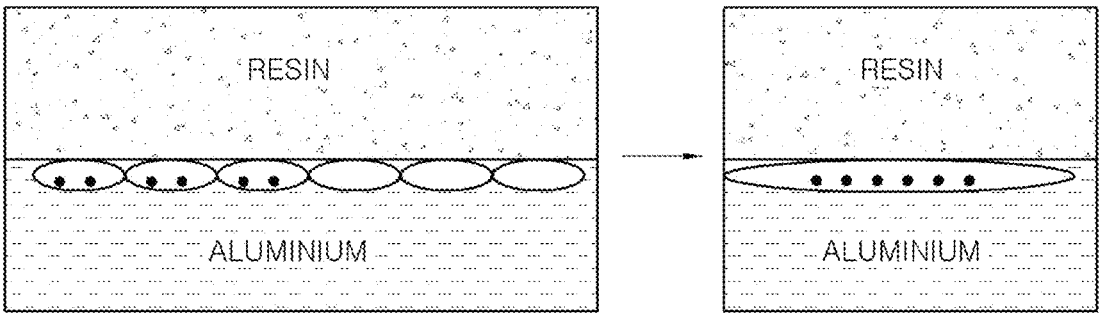
FIG. 2 illustrates an exemplary bonding of resin and an aluminum alloy member according to an exemplary embodiment of the present invention.

For example, the surface treatment method o may include i) forming one or more undercuts or structures formed underneath the surface of an aluminum alloy member by the steps of degreasing S10, surface treatment S20, powder coating S30 and cleaning S40, as shown in FIG. 2, and ii) coating a powder on the undercut shape to bond the plastic resin to the adhesive surface.

The degreasing S10 may be a step to remove the oil layer which inhibits the surface treatment of the aluminum alloy member and is carried out with $Na_3PO_4$ aqueous solution.

For example, the $Na_3PO_4$ aqueous solution may have a concentration of about 20 g/l to 40 g/l, and the operating condition may be 0.5 to 3 minutes of cathode degreasing at current density of about 1 to 4 A/dm and voltage of about 4 to 6V.

The surface treatment step S20 may include the step of etching surface of the aluminum alloy member by three steps.

The primary etching step may include immersing the aluminum alloy member in an aqueous solution of $CrO_3$ and corroding the aluminum component of the surface.

The $CrO_3$ may be included in an aqueous solution at a concentration of about 150 g/l to 200 g/l, and the operating condition is a condition for immersing at a temperature of about 20 to 30° C. for about 3 minutes.

The secondary etching step may include immersing the aluminum alloy member in $FeCl_3$ aqueous solution and corroding the Si component of the aluminum base material.

The $FeCl_3$ may be included in an aqueous solution at a concentration of about 50 g/l to 150 g/l, and the operating condition is a condition of immersing at a temperature of about 20 to 30° C. for about 0.5-1 minutes.

The tertiary etching step may include immersing the aluminum alloy member in an HCl aqueous solution, for example, to corrode again the aluminum component deeper through the penetration etching after $FeCl_3$ treatment and to corrode faster than the first etching step.

The HCl may be included in the aqueous solution in an amount of about 50 g/l to 150 g/l, and the operating condition is a condition of immersing at a temperature of about 20 to 30° C. for about 0.5 to 1 minutes.

Figure 3:
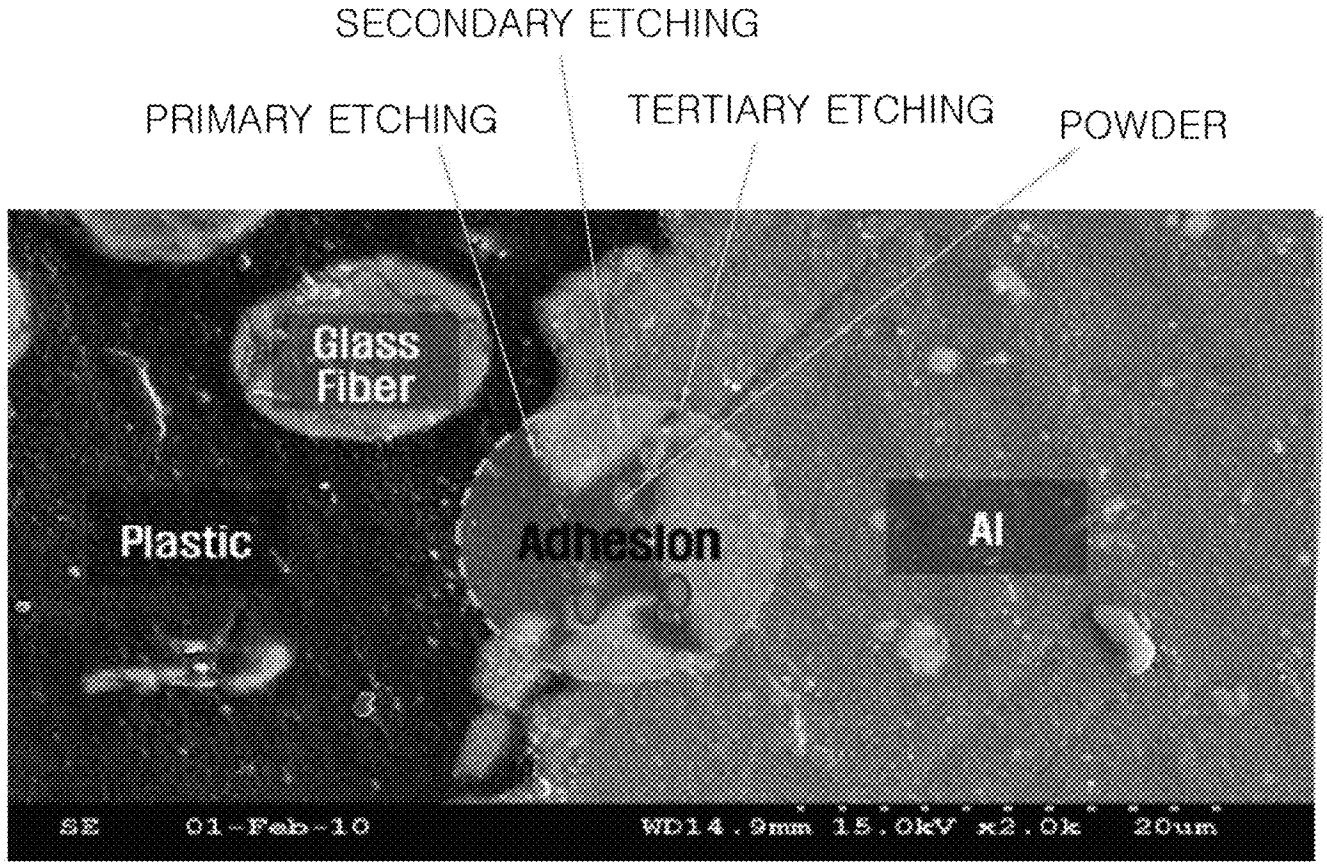
FIG. 3 shows an example surface-treated according to an exemplary embodiment of the present invention.

By the step S20 of the surface treatment by the three steps etching, as shown in FIG. 3, hook-shaped undercuts may be formed on the bonding surface of the aluminum alloy member, and these undercuts may be immersed in a solution containing $TiO_2$ powder to perform powder coating S30.

For example, by forming a hook-shaped undercut by the primary surface etching, the secondary undercut etching and the tertiary penetration etching as shown in the FIGS., a higher adhesion may be secured.

Figure 6:
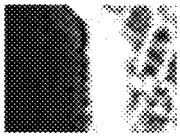
FIG. 6 shows images of adhesion and surface organization according to etching by steps.
Figure 6:
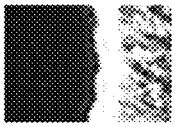
Figure 6:
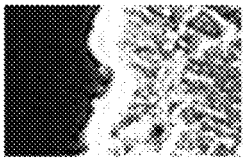
Figure 6:
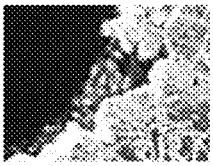

FIG. 6 summarizes the images of adhesion and surface organization according to etching by steps.

Furthermore, the present invention does include a coating layer including $SiO_2$ powder, but instead, includes $TiO_2$ as a powder.

When the $SiO_2$ powder is used, the adhesion may be weaken at pH of weak alkali or acid. However, according to exemplary embodiments of the present invention, when the $TiO_2$ powder is used, the $TiO_2$ powder may be more suitable because of its low reaction with water and greater thermal stability than $SiO_2$.

As shown in FIG. 3, because the $TiO_2$ powder exists between resin and aluminum so that not only the surface area is widened to increase the adhesion but also flame resistance and corrosion resistance may be substantially improved, thereby maintaining the bonding force even in a high temperature and high humidity environment.

In addition, because the powder should be coated on the undercut shape, in the present invention, the coating layer may be well formed to the undercuts by coating the powder by the immersion method without using the plasma method, thereby contributing to the bonding performance.

The resulting bonding performance will be described later.

The $TiO_2$ powder was included in an aqueous solution in an amount of 20 mg/l, and it is preferable to immerse at a temperature of about 20 to 30° C. for about 0.5-1 minutes.

In this condition, when the powder may be dipped and then dried, the powder may settle to the surface.

After the powder coating, the aluminum surface treatment may be completed when immersing in a solution containing ethylene at a temperature of about 20 to 30° C. for about 1 minute and cleaning S40.

The bonding performance of the aluminum surface treatment method by the above-described composition and method was verified using a tensile tester.

Figure 4:
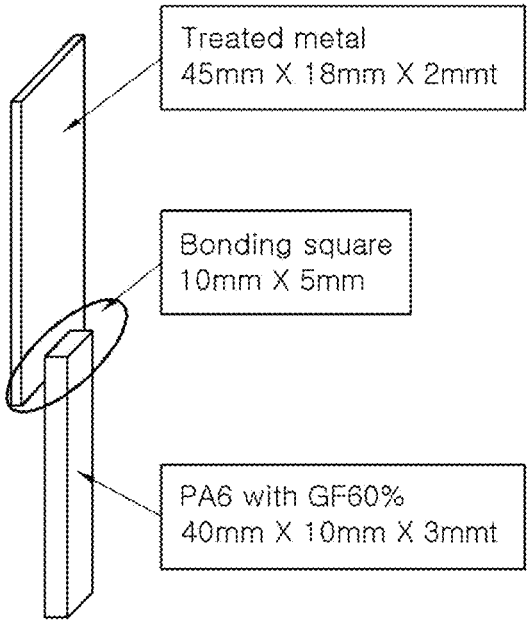
FIG. 4 shows an exemplary test piece for evaluation of adhesion according to an exemplary embodiment of the present invention.

FIG. 4 is an example of producing a test piece, in which an A6063 aluminum alloy member having a size of 45 mm×18 mm×2 mm was bonded to a plastic member (PA6-GF60% resin) having a size of 40 mm×10 mm×3 mm, and the bonding area was 10 mm×5 mm, and then, the experiment was performed.

Table 1 shows the test results for $TiO_2$ compared to $SiO_2$, and Table 3 shows the test results for coating $TiO_2$ powder.

As can be seen from the tables, adhesion at the high temperature may be substantially improved when $TiO_2$ is applied compared to where $SiO_2$ is applied, or nothing is applied. Moreover, the high temperature adhesion may be substantially improved when immersion coating is applied compared to the case that plasma coating is performed, or nothing is performed.

TABLE 1

| Division | $SiO_2$ | $TiO_2$ | Not applied |
|---|---|---|---|
| Water reaction | Existence(softening) | None | — |
| room temperature adhesion (MPa) | 30 | 40 | 30 |
| High temperature adhesion (containing moisture, MPa) | 10 | 30 | 10 |

TABLE 2

| Division | Plasma coating | Immersion coating | Not applied |
|---|---|---|---|
| room temperature adhesion (MPa) | 30 | 40 | 30 |
| High temperature adhesion (containing moisture, MPa) | 10 | 30 | 10 |

Figure 5A:
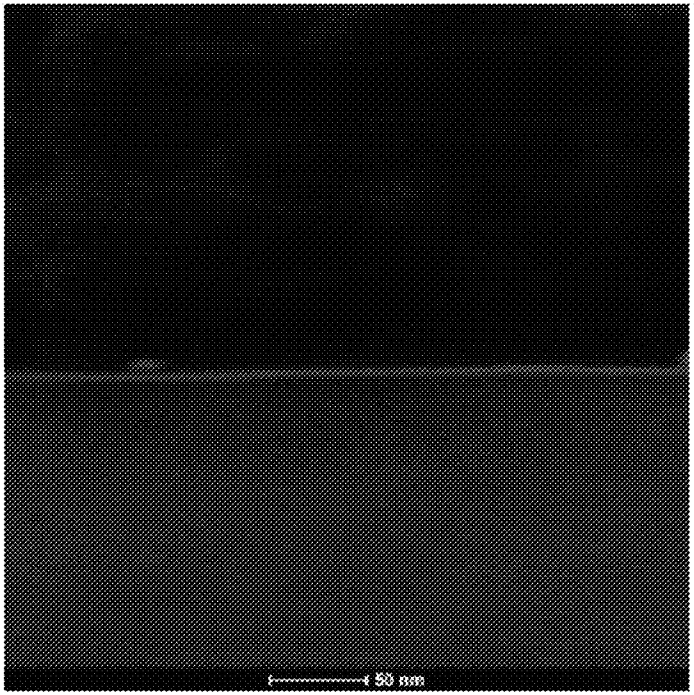
FIG. 5A is a photograph of an exemplary surface of the aluminum alloy member from plasma coating (conventional method)
Figure 5B:
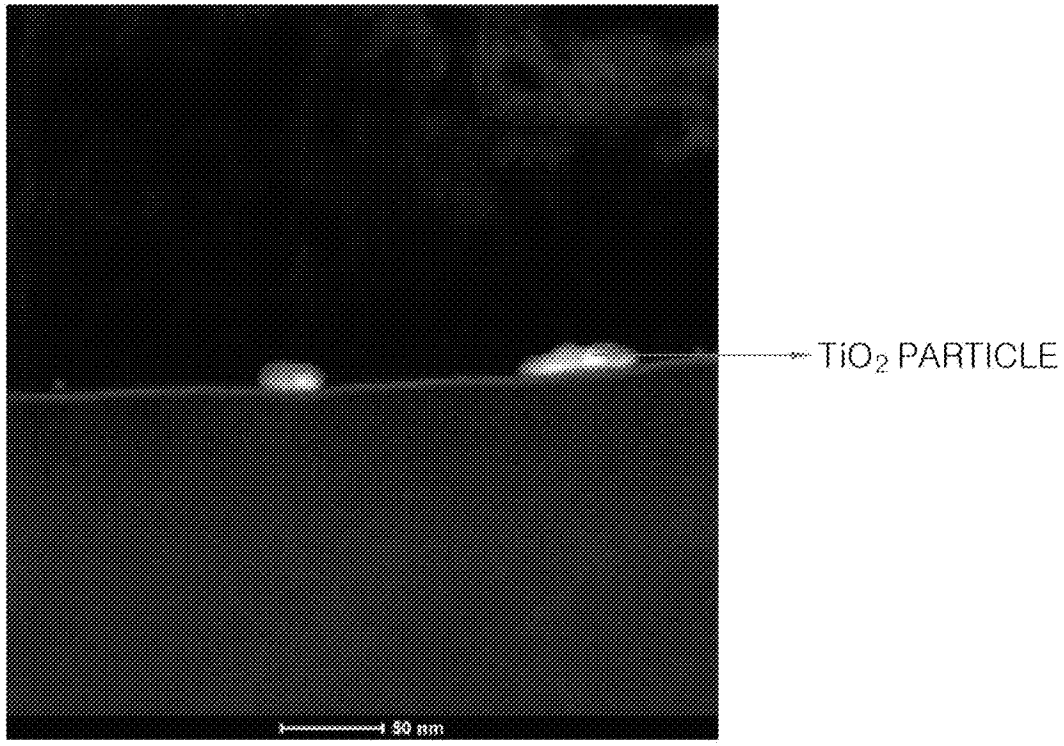
FIG. 5B is a photograph of an exemplary surface of the aluminum alloy member from immersion coating according to an exemplary embodiment of the present invention.

FIG. 5A is a surface photograph of the case of plasma coating, and FIG. 5B is a surface photograph of case of immersion coating.

As shown in FIG. 5A and FIG. 5B, $TiO_2$ particles are hardly visible when plasma coating and $TiO_2$ particles are confirmed in immersion coating.

Likewise, bonding performance as shown in Table 2 is demonstrated.

Although the present invention has been described with reference to the drawings, it will be apparent to those skilled in the art that the invention is not limited to the exemplary embodiments set forth herein but that various modifications and variations can be made therein without departing from the spirit and scope of the present invention.

Accordingly, such modifications or exemplary variations should fall within the scope of the claims of the present invention, and the scope of the present invention should be construed on the basis of the appended claims.

What is claimed is:

1. A method of fabricating an aluminum alloy member, comprising:

etching a surface of the aluminum alloy member using one or more etching solutions; and forming one or more undercuts on the surface of the aluminum alloy member, wherein the one or more undercuts are formed by:

a first etching of immersing the aluminum alloy member in an $CrO_3$ aqueous solution;

a second etching of immersing the aluminum alloy member in an $FeCl_3$ aqueous solution; and a third etching of immersing the aluminum alloy member in an HCl aqueous solution.

2. The method of claim 1, wherein the first etching comprises immersing the aluminum alloy member in the $CrO_3$ aqueous solution of at a temperature of about 20 to 30° C.

3. The method of claim 2, wherein the first etching comprises immersing the aluminum alloy member in the $CrO_3$ aqueous solution for about 3 minutes.

4. The method of claim 2, wherein the $CrO_3$ aqueous solution has a concentration of $CrO_3$ of about 150 g/l to 200 g/l.

5. The method of claim 1, wherein the second etching comprises immersing the aluminum alloy member in the $FeCl_3$ aqueous solution of a temperature of about 20 to 30° C.

6. The method of claim 5, wherein the second etching comprises immersing the aluminum alloy member in the $FeCl_3$ aqueous solution for about 0.5 to 1 minutes.

7. The method of claim 5, wherein the $FeCl_3$ aqueous solution has a concentration of $FeCl_3$ of about 50 g/l-150 g/l.

8. The method of claim 1, wherein the third etching comprises immersing the aluminum alloy member in the HCl aqueous solution of a temperature of about 20 to 30° C.

9. The method of claim 8, wherein the third etching comprises immersing the aluminum alloy member in the HCl aqueous solution for about 0.5-1 minutes.

10. The method of claim 8, wherein the HCl aqueous solution has a concentration of HCl of about 50 g/l to 150 g/l.

11. The method of claim 1, further comprising coating $TiO_2$ powder on the one or more undercuts.

12. The method of claim 11, wherein the coating the $TiO_2$ powder comprises immersing the aluminum alloy member in an $TiO_2$ aqueous solution comprising the $TiO_2$ powder.

13. The method of claim 12, wherein the $TiO_2$ aqueous solution has a concentration of the $TiO_2$ powder of about 20 mg/l.

14. The method of claim 13, wherein the coating the $TiO_2$ powder comprises immersing the aluminum alloy member in the $TiO_2$ aqueous solution at a temperature of about 20 to 30° C.

15. The method of claim 14, wherein the coating the $TiO_2$ powder comprises immersing the aluminum alloy member in the $TiO_2$ aqueous solution for about 0.5 to 1 minutes.

* * * * *